US005628289A

United States Patent [19]

Chang

[11] Patent Number: 5,628,289

[45] Date of Patent: May 13, 1997

[54] SMOKE EXHAUSTER

[76] Inventor: Hsing-Wen Chang, 7F-2, No. 95-8 Chang Ping Road, Sec. 1, Taichung, Taiwan

[21] Appl. No.: 570,493

[22] Filed: Dec. 11, 1995

[51] Int. Cl.[6] ..... F24C 15/20

[52] U.S. Cl. ..... 123/299

[58] Field of Search ..... 126/299 R, 299 D, 126/300, 301, 299 F

*Primary Examiner*—Noah P. Kamen

[57] ABSTRACT

A smoke exhauster comprises an enclosure including a fan housing and a flood plate releasably secured thereunder. The enclosure has a plurality of spiral coupling recesses on the top plate for releasable securing the fan housing by a T-shaped fastener. The hood plate has at four corners a sliding catch member positioned in registry with the corresponding locking holes on the enclosure so as to permit the hood plate to be slidingly secured to the enclosure. The hood plate can be suspended from the rear of the enclosure if the sliding catch member on the rear is not intended to be disengaged. This arrangement provides faster and more convenient assembly or disassembly of the smoke exhauster for facilitating a rapid removal of the oil and grime accumulated on them.

6 Claims, 4 Drawing Sheets

SMOKE EXHAUSTER

BACKGROUND OF THE INVENTION

The present invention relates to a smoke exhauster and more particualrly to a structurally improved smoke exhauster which has a quick releasable device for facilitating a rapid and thorough cleaning of the exhauster.

Typically, a smoke exhauster generally has an enclosure including lateral plates and front panel, a pair of fan rotors enclosed in a fan housing and a hood plate attached to the lower portion of the enclosure.

The smoke exhauster is disposed over a stove or cooking range in a kitchen. The cleaning of the hood plate and fan housing is usually a tiresome task to the user especially when a smoke exhauster is found not readily releasable.

In the U.S. Pat. No. 5,311,857, a pair of pivoting catches at rear side of the hood plate releasably engage a pair of locking bars respectively on the enclosure and a pair of tabs at the front side of the hood plate are supported by a protruding edge of the rear panel of the enclosure. The fan housing has a pair of spring catches releasably engage with a pair of corresponding hook-shaped securing appendages. So that both the hood plate and the fan housing are releasable and facilitate the cleaning of oil and grime accumulated on them. However, this smoke exhauster has been found disadvantageous on that the lever of the spring catch is harmful to user's finger when the fan housing engages with enclosure and that the tabs of the hood plate supported by the protruding edge of the panel are found not so stable because of the deformation of both of the tabs and the protruding edge. Besides, it is difficult to align the pivoting catches the the locking bars after the tabs are supported on the edge. When the pivoting catches are disengaged with the locking bars, the hood plate must be immediate taken out of the enclosure and laid down on an appropriate plate. This causes a great inconvenience for the user.

SUMMARY OF THE PRESENT INVENTION

The present invention has a main object to provide a structure of smoke exhauster which has a quick releasble device to facilitate a ready assembly and disassembly of the fan housing and the hood plate from the enclosure for rapid removal of the oil and grime accumulated on the surface of the exhauster.

Accordingly, the smoke exhauster of the present invention generally comprises a rectangular enclosure including lateral plates and front panel extended downward from four sides, a fan housing enclosed with the contrifugal suction fans and a concave hood plate releasably mounted on the lower portion of the enclosure. This invention is characterized in a spiral coupling recess which is mounted the fan housing onto the enclosure and a sliding catch member which is used to fix or suspend the hood plate from the enclosure. Both the spiral coupling recess and the sliding catch member are designed to provide more convenient assembly or disassembly of the fan housing and the hood plate from the enclosure so as to facilitate a rapid removal of the oil and grime accumulated on them.

The present invention will become more fully understood by reference to the following detailed description thereof when read in conjunction with the attached drawings.

DETAILED DESCRIPTION OF THE PREFERRED EMBODIMENT

Figure 1:
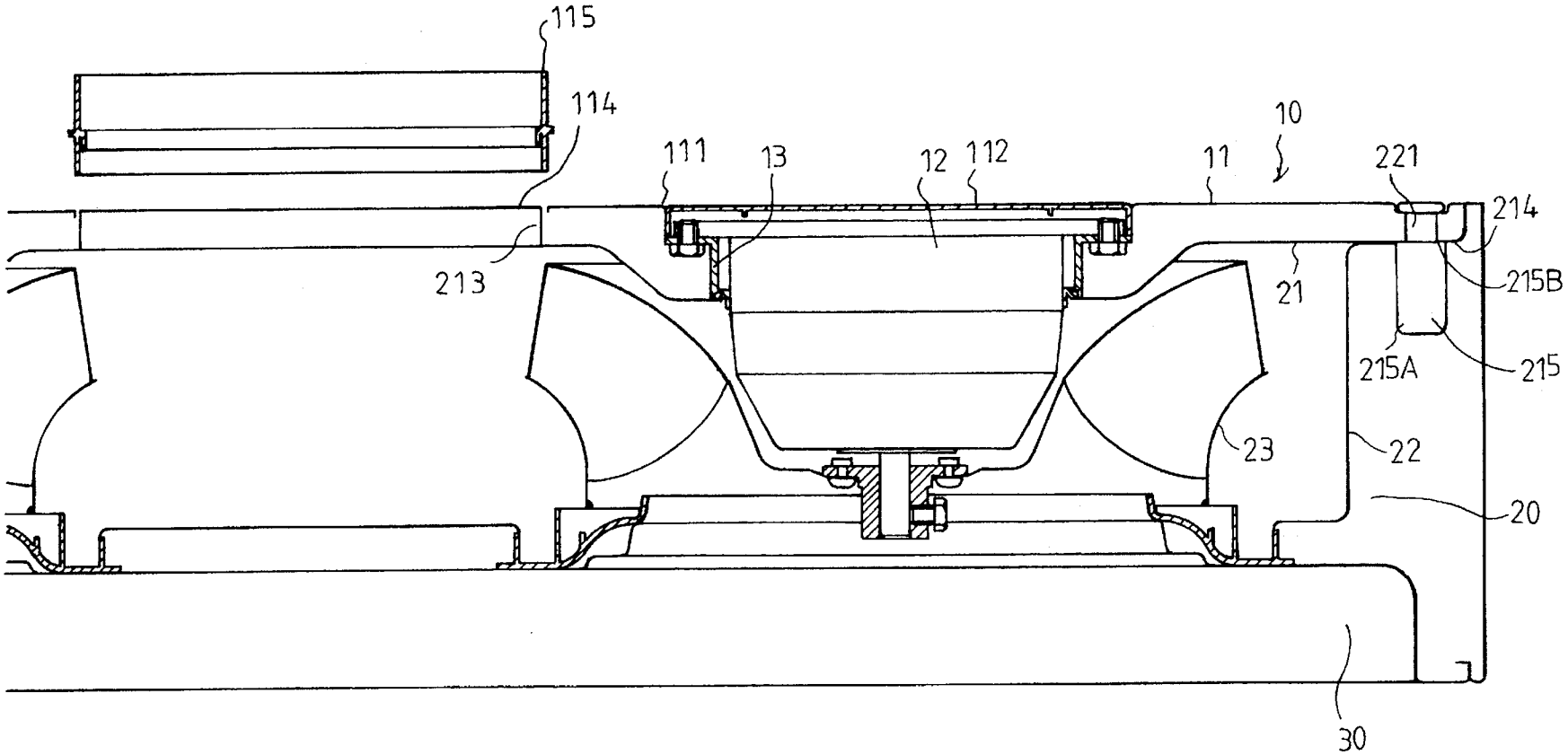
FIG. 1 is a elevational section illustrating the preferred embodiment according to the present invention.

With reference to FIG. 1 of the drawings, the smoke exhauster of the present invention comprises generally an enclosure 10, a fan housing 20 and a concave hood plate 30.

The enclosure 10 is composed of a rectangular housing 11 including a top plate, a pair of lateral plates and a front panel extending downward from four sides. Fan rotor 23 rotatably mounts on a motor 12 which in turn mounts to the seat 111 on the top plate of the housing 11 and is sealed by scaling members 13 and 112. A curved reinforcement plate 21 is formed under the top plate and connects with the sealing member 13 to define a space therebetween. Vent 113 communicates to an exit 114 which connects to a ventilating pipe 15.

Figure 3:
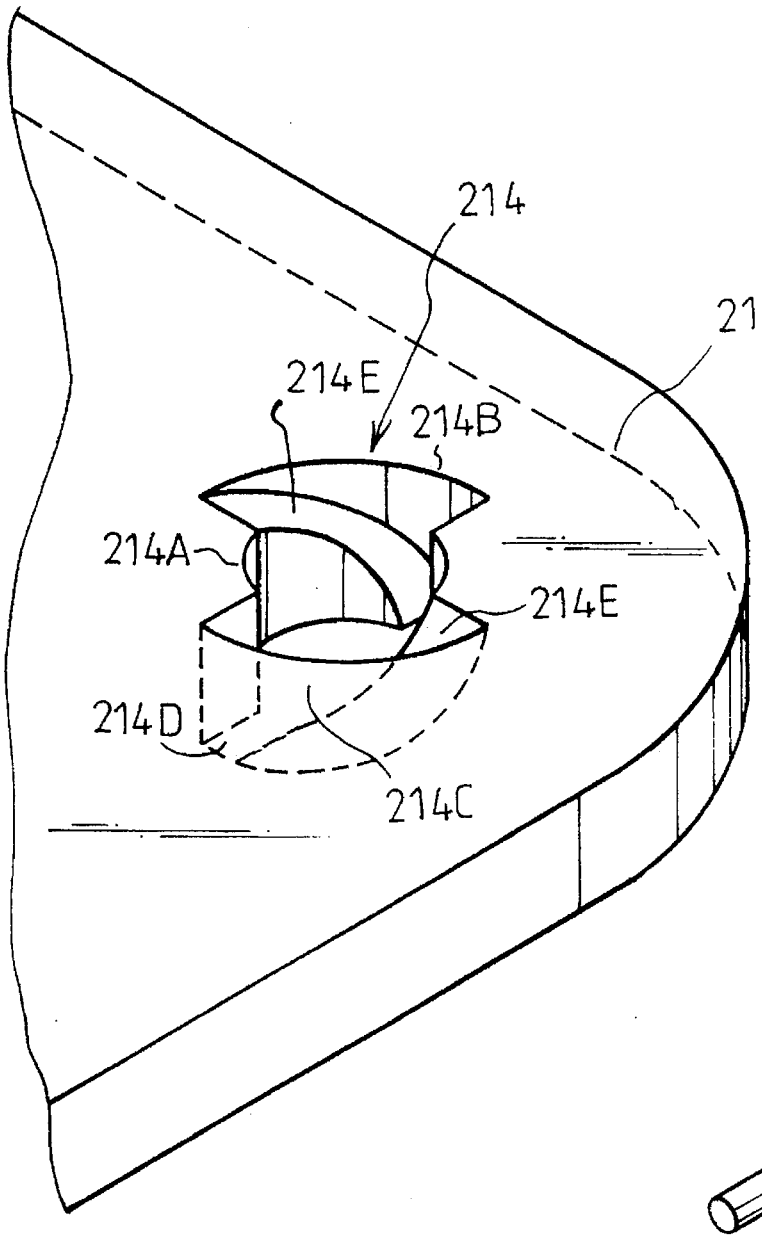
FIGS. 3 and 3A are the perspective views to show a spiral coupling device between the fan housing and the enclosure of the smoke exhauster of the present invention.
Figure 3A:
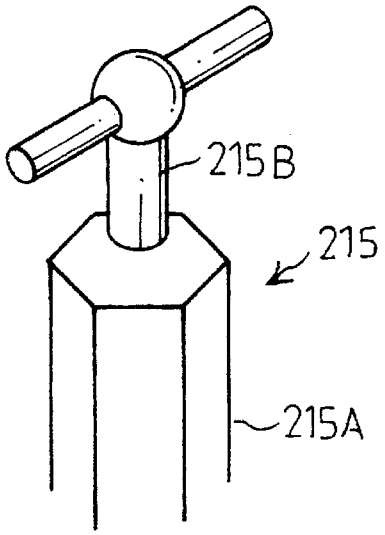

A plurality of spiral coupling recesses 214 are formed between the top plate of the housing 11 and the reinforcement plate 21 (as shown in FIG. 3) and comprises circular circumferences on the top plate, a circular hole 214C on the reinforcement plate 21 made in registry with the hole 214A abutting a pair of rectangular portions 214D at opposing circumferences of the coupling recess 214 and a pair of sloped strips 214E connect between the top plate and the reinforcement plate 21. The sloped strips 214E start from the respective sectorial portion 214B of the top plate and terminate at a respective rectangular portion 214D of the reinforcement plate 21. So that the spiral coupling recess 214 is therefore accomplished. A fastener 215, as shown in FIG. 3A is provided to cooperate with the coupling recess 214 which is composed of a hexagon shank 215A and a T-shaped head 215B. Further, the fan housing 22 has also a plurality of coupling holes 221 made in registry with holes 214C. To mount the fan housing 22 is to align the hole 221 with hole 214C at first and insert the T-shaped head of the fastener 215 into hole 221 and 214C sequentially and then swing the shank 215A clockwise so as to slide the transverse portion of the T-shaped head 215B upwardly along the pair of the sloped strips 214E until that the T-shaped head is retained on the upper surface of the top plate of the housing 11. Therefore, the fan housing 22 is readily mounted onto the enclosure 10. This arrangement provides faster and more convenient assembly or disassembly of the fan housing 22 to the enclosure 10.

Figures 2, 2A:
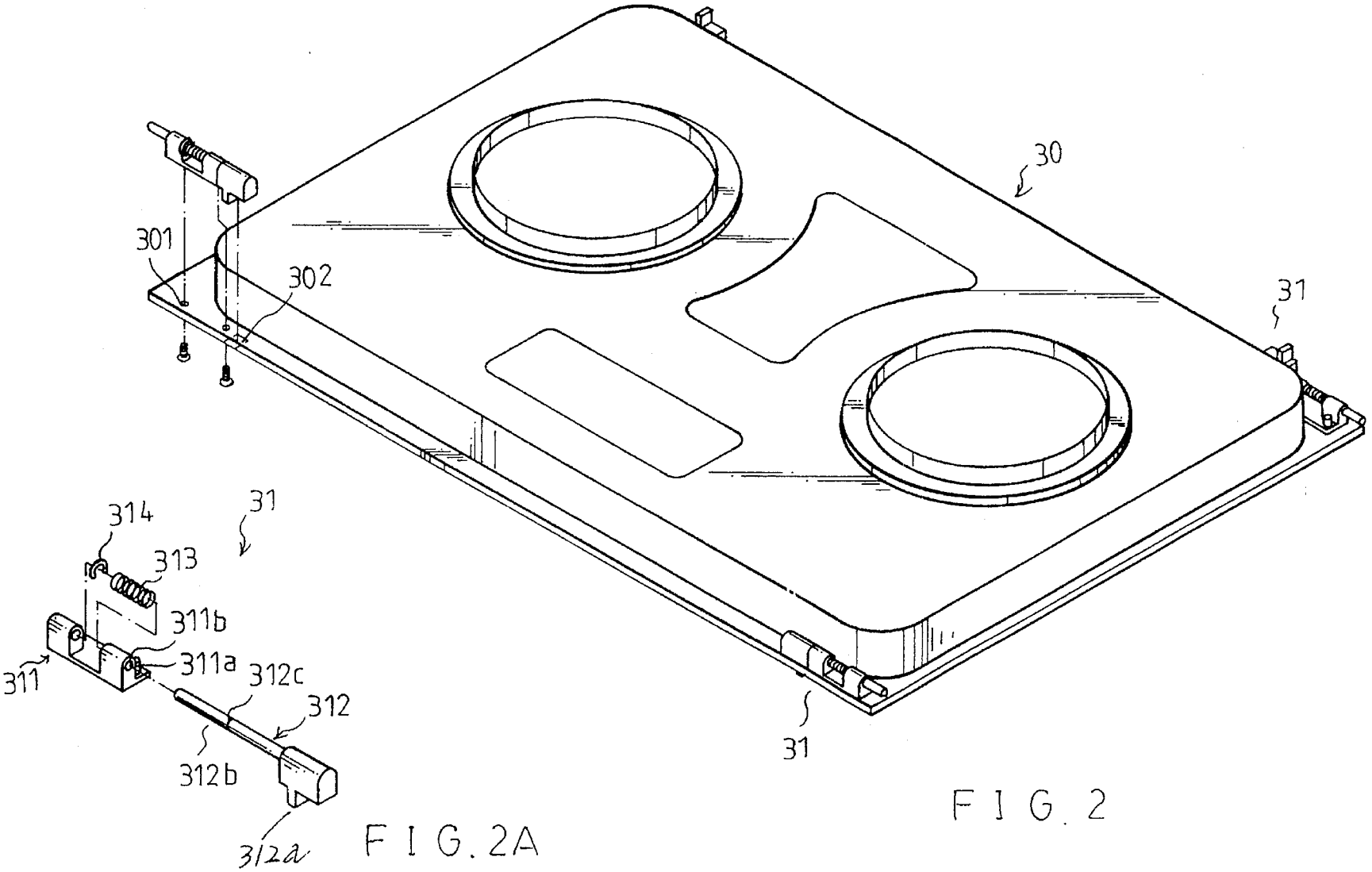
FIGS. 2 and 2A are the perspective views to show the sliding catch member of the present invention.

Referring to FIGS. 2 and 2A, a sliding catch member 31 is shown secured to each corner of the hood plate 30 in registry with the locking cavities on the respective positions of the inward walls of the lateral plate of the housing 11. The sliding catch member 31 comprises a lug of a roughly L-shaped section 311, a latch 312, a compression spring 313 and a retaining ring 314. The lug 311 has a pair of screw holes 311*a* on the planar portion made in registry with the corresponding screw holes 301 on the flange of the hood plate 30, an axial aperture 311*b* through each of it's upright ears. The latch 312 has a press tab 312*a*, a locking rod 312*b* longer than the lug 311 and an annular groove 312*c* in the outer periphery of the locking rod 312*b*. When assembling, the spring 313 is located at the space between the ears of the lug 311 and insert the locking rod 312*b* of the latch 312 through the aperture 311*b*, and the spring 313 then secures the retaining ring 314 into the groove 312*c*. The latch 312 is retained and biased by spring 313 and slides about the lug 311 therewithin.

The sliding catch member 31 is screw secured to each corner of the upper surface of the flanges of the hood plate 30 as shown in FIG. 2. With that, the catch members 31 on the front side of the hood plate 30 turn their press tabs downward and pass through the rectangular recesses 302 in the flange so as to permit the press tabs to be accessible from the under side of the hood plate 30 and sliding about the recesses 302 therewithin, where, the catch members 31 on the rear side of the hood plate 30 turn their press tabs upward so as to permit the press tabs to be accessible from the top of the hood plate 30.

Figure 4:
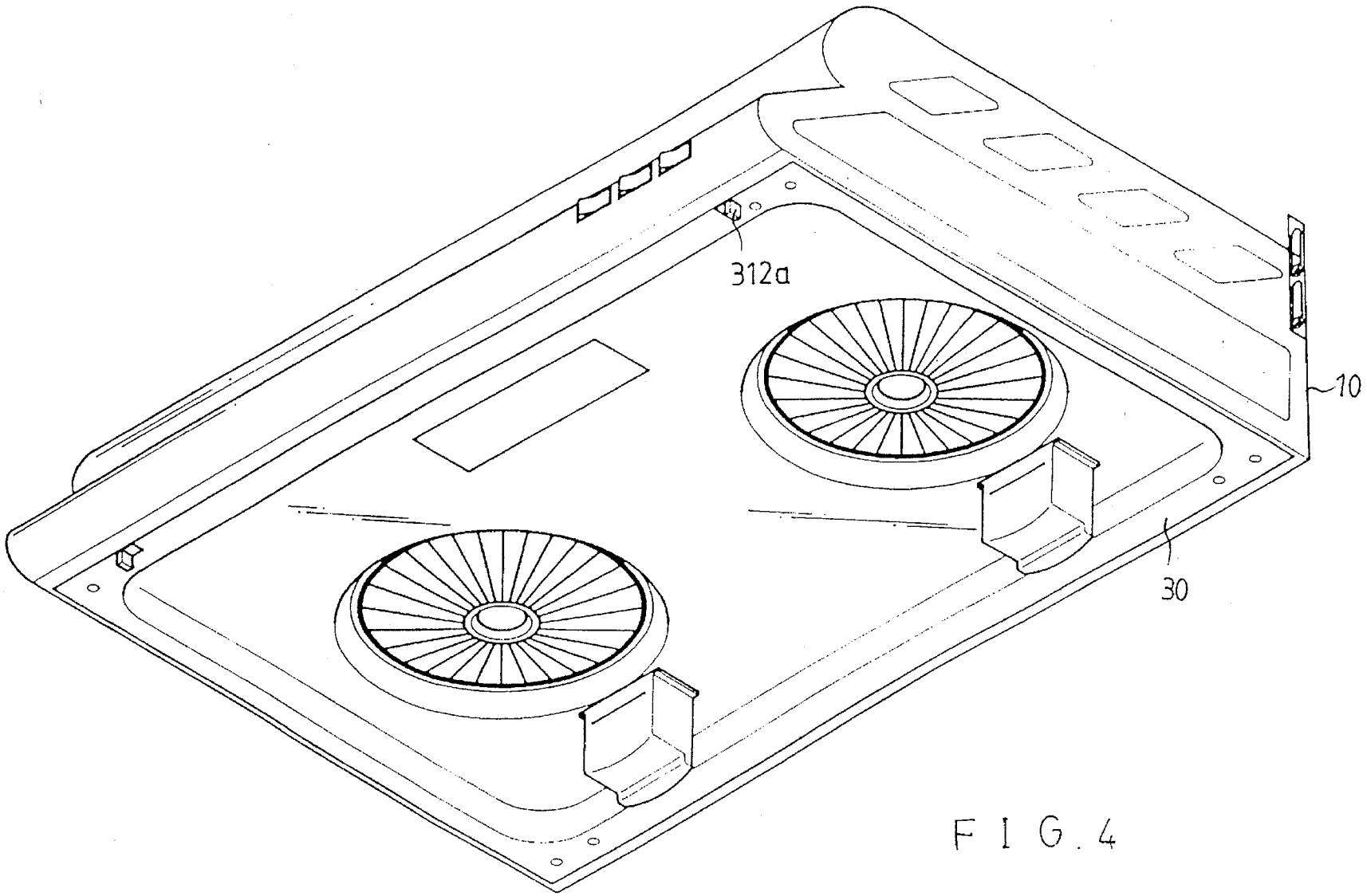
FIG. 4 is a perspective view to show an assembled smoke exhauster of the present invention.

When assembling, the sliding catch members 31 on the rearside of the hood plate 30 engage with the respective locking holes (not shown) on the enclosure 10 at first so that the hood plate 30 is suspended from the rear side of the enclosure 10. Then swing the hood plate 30 into place in the front of the enclosure 10 and apply the press tabs of the two catch members 31 simultaneously to engage the locking rods 312*b* into their respective locking recesses in the enclosure 10 and urged by the springs 313. Thus the hood plate 30 is completely engaged onto the enclosure 10 as shown in FIG. 4.

Upon this arrangement. the sliding catch member 31 not only provides ready and faster engagement of the hood plate 30 with enclosure 10 but also provides a possibility to suspend the hood plate 30 from the rear side of the enclosure 10 when the user has no intention to remove the hood plate 30 from the enclosure 10 during cleaning or fixing the fan housing 20 or the rotors.

Note, the specification relating to the above embodiment should be construed as exemplary rather than as limitative of the present invention, with many variations and modifications being readily attainable by a person of average skill in the art without departing from the spirit or scope thereof as defined by the appended claims and their legal eqnivalents.

I claim:

1. A smoke exhauster comprising:

an enclosure composed of a housing including a top plate, a pair of lateral plates and a front panel, a vent member communicating to an exit at a top of said housing, at least one motor with a suction fan rotatably coupled thereunder and secured under the top plate of said housing;

a fan housing disposed within said enclosure surrounding said suction fan and said vent member;

at least one spiral coupling recess on the top plate of said housing made in registry with one circular hole of equal diameter on said fan housing which is releasably secured to the top plate of said housing by fastener means;

a concave hood plate releasably attached under said enclosure by at least one sliding catch member means;

at least one locking hole on an inner wall of the lateral plates of said housing positioned in registry with said at least one sliding catch member means;

whereby, said fan housing and said hood plate are readily attached to or removed from said enclosure.

2. A smoke exhauster according to claim 1, wherein said at least one spiral recess comprises:

a first circular hole on the top plate of said housing abutting a pair of sectorial portions at opposing circumferences thereof;

a second circular hole on a reinforcement plate under the top plate of said housing having an equal diameter to said first circular hole and abutted at a pair of rectangular portions at opposing circumferences thereof;

a pair of sloped strip member respectively connected with said rectangular portions and said sectorial portions between said first and second circular holes.

3. A smoke exhauster according to claim 1 wherein said fastener means comprises a hexagon shank and a T-shaped head perpendicular to an upper end of said shank.

4. A smoke exhauster according to claim 1 wherein said sliding catch member means comprises screws secured at each corner on an upper surface of the flanges of said hood plate, each screw comprises:

a lug member of an L-shaped section having a plurality of screw holes on a planar portion thereof and made in registry with corresponding screw holes on four corners of said hood plate, an axial recess on each of upright ears thereof;

a latch member including a press tab and a locking rod extended transversely therefrom with an annular groove on an outer periphery thereof, said latch member having it's locking rod inserted through the axial recesses of said upright ears and a biasing spring and secured by a retaining ring within said annular groove between said upright ears so that said latch member can slide about said lug member therewithin.

5. A smoke exhauster according to claim 4, wherein said at least one catch member on a front side of said hood plate comprises a press tab positionable downward and slidingly received by a rectangular recess on said hood plate.

6. A smoke exhauster according to claim 4, wherein said at least one catch member on a rear side of said hood plate has an upwardly directed press tab.

* * * * *